US008051579B2

(12) United States Patent
Ueda et al.

(10) Patent No.: US 8,051,579 B2
(45) Date of Patent: Nov. 8, 2011

(54) DRYER FOR HAIR SHAVING DEVICE

(75) Inventors: Yasunori Ueda, Hikone (JP); Minoru Kashiwabara, Hikone (JP); Yasuo Ibuki, Hikone (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 822 days.

(21) Appl. No.: 12/149,625

(22) Filed: May 6, 2008

(65) Prior Publication Data

US 2008/0282576 A1 Nov. 20, 2008

(30) Foreign Application Priority Data

May 14, 2007 (JP) ..... 2007-128509

(51) Int. Cl.
*F26B 19/00* (2006.01)
*F26B 25/06* (2006.01)
*B26B 19/38* (2006.01)

(52) U.S. Cl. ..... 34/549; 34/553; 34/554; 34/562; 34/90; 34/202; 34/218

(58) Field of Classification Search ..... 34/524, 34/549, 553, 554, 562, 90, 202, 218; 30/32, 30/34.05
See application file for complete search history.

(56) References Cited

U.S. PATENT DOCUMENTS

| | | | | |
|---|---|---|---|---|
| 5,163,234 | A * | 11/1992 | Tsukamoto et al. | 34/487 |
| 5,614,030 | A | 3/1997 | Braun | |
| 5,649,556 | A | 7/1997 | Braun | |
| 2005/0126611 | A1 | 6/2005 | Eichhorn et al. | |
| 2009/0211801 | A1 | 8/2009 | Edwards et al. | |

FOREIGN PATENT DOCUMENTS

| | | |
|---|---|---|
| CN | 2450983 | 10/2001 |
| DE | 44 02 236 | 7/1995 |
| JP | 08-117016 | 5/1996 |
| JP | 10-094685 | 4/1998 |
| JP | 2003-070170 | 3/2003 |
| JP | 2005-518851 | 6/2005 |
| JP | 2005-199083 | 7/2005 |
| JP | 2005-201507 | 7/2005 |
| JP | 2005-261217 | 9/2005 |
| JP | 2009-199083 | 9/2009 |

* cited by examiner

*Primary Examiner* — Jiping Lu
(74) *Attorney, Agent, or Firm* — Bacon & Thomas, PLLC

(57) ABSTRACT

A dryer for hair shaving devices includes a casing having a drying space for removably receiving a blade portion of a hair shaving device, and a heater and a fan for drying the blade portion received in the drying space. Also, a control unit is provided for controlling output power of the heater and the fan to perform operation modes, the operation modes include a drying operation mode in which the heater and the fan are driven simultaneously and a sterilizing operation mode in which the heater alone is driven with the fan kept stopped.

4 Claims, 14 Drawing Sheets

DRYER FOR HAIR SHAVING DEVICE

FIELD OF THE INVENTION

The present invention relates to a dryer for hair shaving devices and, more specifically, to a dryer for hair shaving devices capable of sterilizing a blade portion of a hair shaving device and keeping the same in a hygienic state.

BACKGROUND OF THE INVENTION

Hair pieces or facial grease components are apt to adhere to a blade portion of an electric razor, which is one of hair shaving devices. It is difficult to remove the hair pieces or facial grease components by merely cleaning the blade portion with a brush or the like. The hair pieces or facial grease components tend to leave an unpleasant smell.

In view of this, there is conventionally known an electric razor including a shaver head, a heat generation unit arranged within the shaver head for generating heat for a drying purpose and a protection member received within the shaver head for covering and protecting a blade portion, wherein the blade portion is dried by the heat generated from the heat generation unit (see, e.g., Japanese Patent Laid-open Publication No. 2005-199083).

Since the heat generation unit and the protection member are built within the shaver head, however, the conventional electric razor disclosed in Japanese Patent Laid-open Publication No. 2005-199083 has a problem in that the structure thereof becomes complicated and large-sized due to the increase in the number of parts.

In recent years, a shaver cleaning and drying device is marketed independently of an electric razor. This kind of shaver cleaning and drying device has an upwardly opened cleaning space into which a blade portion of a hair shaving device is inserted upside down. The blade portion is automatically cleaned and dried within the cleaning space. However, since the shaver cleaning and drying device is adapted to clean the blade portion and then dry the same by allowing air to flow through the blade portion, various germs or bacteria adhering to a blade surface or blade holes of the blade portion are not sufficiently sterilized but are left alive. This poses a problem in that it is impossible to keep the blade portion hygienic.

SUMMARY OF THE INVENTION

In view of the foregoing, the present invention provides a dryer for hair shaving devices capable of sterilizing a blade portion of a hair shaving devices through the use of simple control and cost-effective structure.

In accordance with an aspect of the present invention, there is provided a dryer for hair shaving devices, including: a casing having a drying space for removably receiving a blade portion of a hair shaving device; a heater and a fan for drying the blade portion received in the drying space; and a control unit for controlling output power of the heater and the fan to perform operation modes including a drying operation mode in which the heater and the fan are driven simultaneously and a sterilizing operation mode in which the heater alone is driven with the fan kept stopped.

With such configuration, the heat generated from the drying heater is transferred to the blade portion during the sterilizing operation mode. Therefore, it becomes possible to sufficiently sterilize various germs or bacteria adhering to the blade surface or blade holes of the blade portion. This eliminates the need to separately provide a sterilization-exclusive member or mechanism, thereby making it possible to obtain a sterilization effect through the use of simple control and cost-effective structure.

The control unit may be designed to perform the drying operation mode for a predetermined time period and then perform the sterilizing operation mode for a specified time period, wherein the heater and the fan is driven simultaneously in the drying operation mode to dry the blade portion with a hot air, and the fan is stopped and the heater alone is driven in the sterilizing operation mode to heat the blade portion by thermal conduction.

It is preferable that the control unit controls the heater in such a condition as to heat the blade portion for ten minutes or more at a temperature of 65° C. or more during the sterilizing operation mode.

The dryer for hair shaving devices in accordance with the present invention is able to perform the drying operation mode and the sterilizing operation mode by controlling the output powers of the heater and the fan and also to perform the sterilizing operation mode by operating only the drying heater. This eliminates the need to separately provide a sterilization-exclusive member or mechanism, thereby making it possible to obtain an effect of sterilizing the blade portion through the use of simple control and cost-effective structure.

BRIEF DESCRIPTION OF THE DRAWINGS

The objects and features of the present invention will become apparent from the following description of embodiments, given in conjunction with the accompanying drawings, in which.

DETAILED DESCRIPTION OF THE PREFERRED EMBODIMENTS

The embodiments of the present invention will be described with reference to the accompanying drawings which form a part hereof.

Figure 4A:
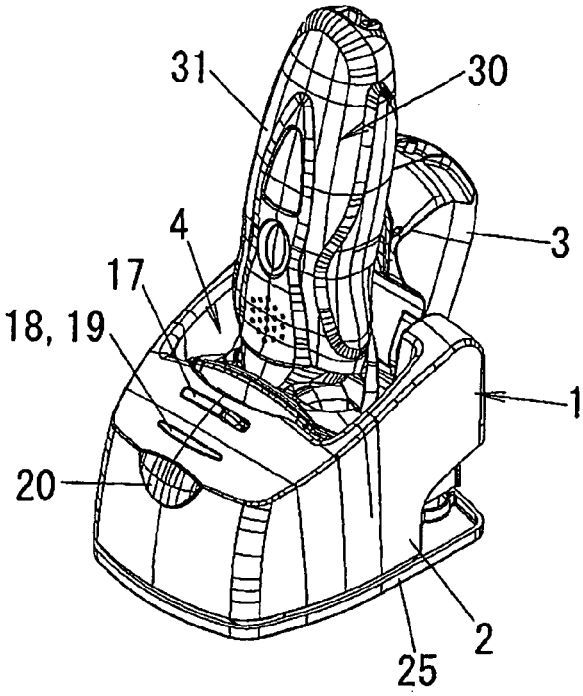
FIGS. 4A to 4D are respectively perspective, front, rear and top views of the dryer for hair shaving devices in case of drying and sterilizing a blade portion.
Figure 5:
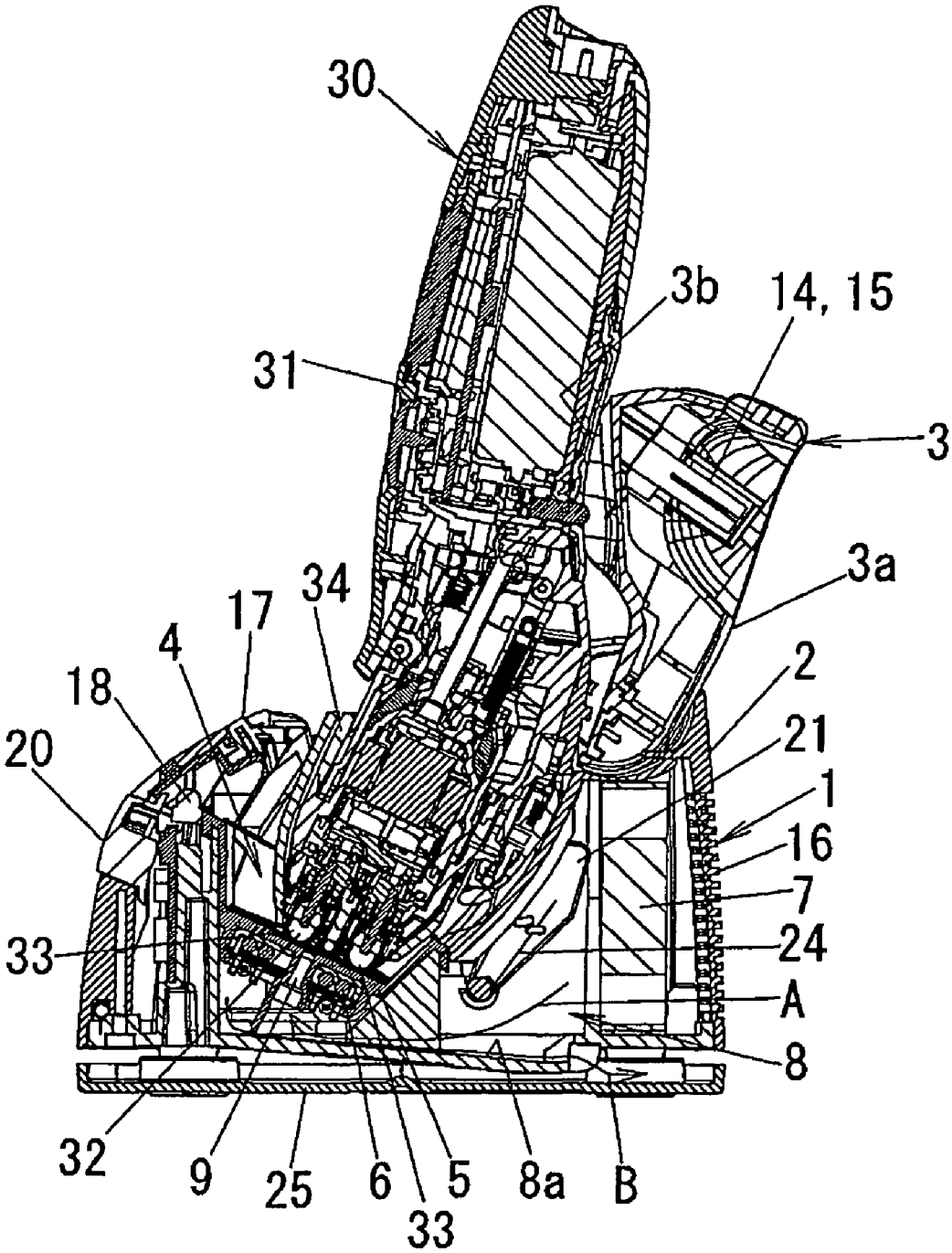
FIG. 5 is a side elevational section view of the dryer for hair shaving devices in case of drying and sterilizing the blade portion.

FIGS. 1 to 3E show a dryer for hair shaving devices 1 in accordance with the present invention (hereinafter referred to as a "dryer 1"). FIGS. 4A and 5 are views illustrating a state that a blade portion 32 of a hair shaving device 30 is inserted into the dryer 1. In the following description, a reciprocating electric razor is cited as an example of the hair shaving device 30.

The dryer 1 includes a box-shaped casing 2 having a drying space 4 formed inside the casing 2. The drying space 4 communicates at its upper end with an upwardly opened blade portion insertion 4*b*. The blade portion 32 is removably inserted into the drying space 4 through the blade portion insertion 4*b* in a downwardly facing state. In a bottom portion of the drying space 4, there is arranged a blade rest tray 5 for receiving the blade portion 32 which will be described below.

The casing 2 has an intake inlet 16 formed in a rear surface thereof. An air guide passageway 8 having a generally "U"-like curved shape when viewed from the side is formed inside the casing 2 and is in communication with the intake inlet 16 at its one end. The air guide passageway 8 communicates at the other end with the drying space 4 through an air passage hole 9 formed in the below-mentioned blade rest tray 5.

A blowing fan 7 is arranged on an upstream side of the air guide passageway 8. The fan 7 may be, e.g., a brushless motor fan that generates a reduced rotating noise and makes superior silence and long lifespan. On a downstream side of the fan 7, a heater 6 attached to a bottom surface of the blade rest tray 5 is arranged.

FIGS. 7A to 8D illustrate one example of the blade rest tray 5 arranged in the bottom portion of the drying space 4 so that it can receive the blade portion 32. The blade rest tray 5 is formed into a generally "U"-like cross section and is upwardly opened. A cylindrical wall 5*a* constitutes the outer circumferential portion of the blade rest tray 5. The cylindrical wall 5*a* ensures that the heat generated from the heater 6 is widely spread toward the blade portion 32 therethrough without leaking to the outside of the blade rest tray 5.

In the present embodiment, the blade rest tray 5 is made of an elastic material. Examples of the elastic material include silicone rubber exhibiting superior flexibility and heat conductivity. The silicone rubber is capable of stably holding the blade portion 32 without damaging a blade surface 33 (shown in FIG. 7B). Furthermore, the silicone rubber makes sure that the heat generated from the heater 6 attached to the bottom surface of the blade rest tray 5 is easily transferred to the blade portion 32. The material of the blade rest tray 5 is not limited to the silicone rubber but may include other elastic materials that exhibit superior heat conductivity.

Figure 7A:
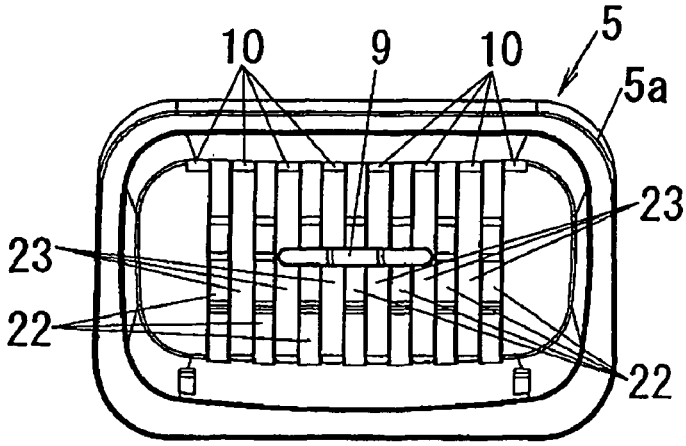
FIGS. 7A to 7E are respectively top, side elevational section, front, side and bottom views showing a blade rest tray of the dryer for hair shaving devices.
Figure 7B:
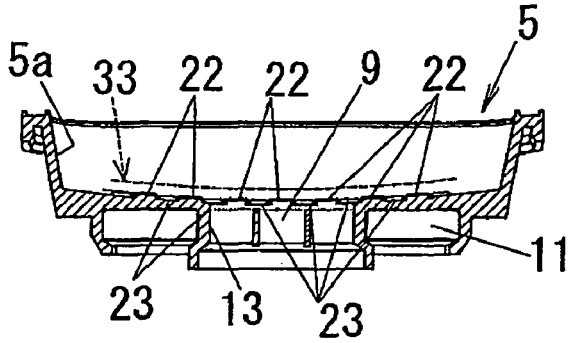
Figure 7C:
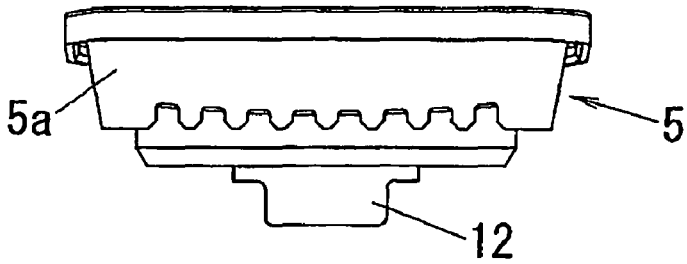
Figure 7D:
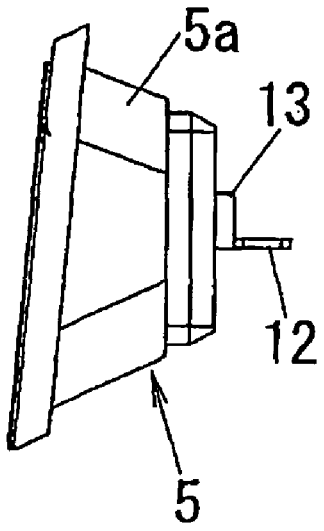
Figure 7E:
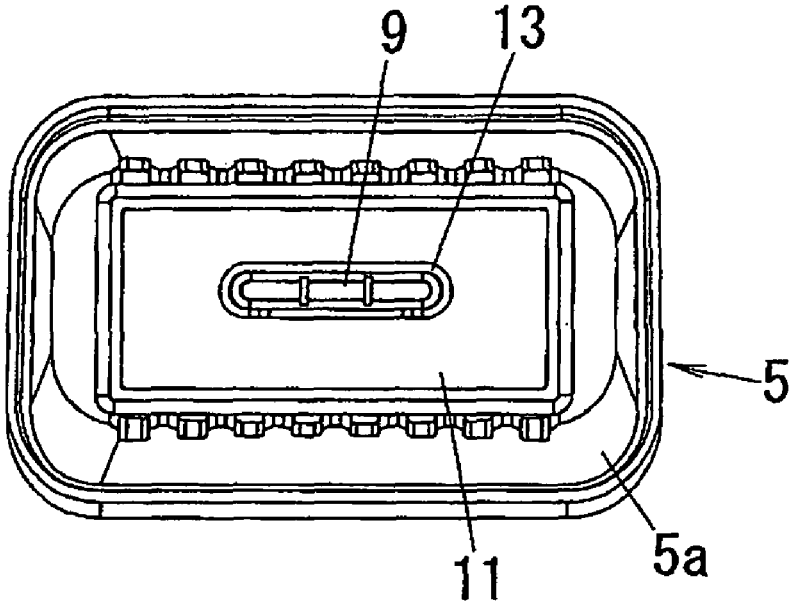
Figure 8A:
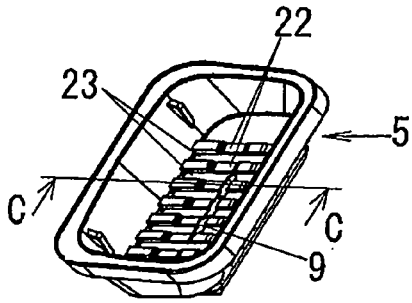
FIG. 8A is a top perspective view of the blade rest tray.
Figure 8B:
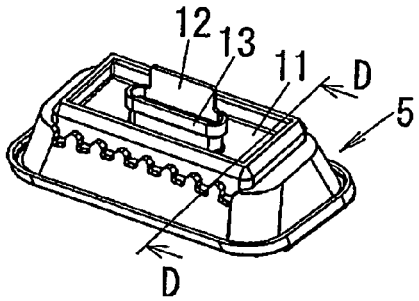
FIG. 8B is a bottom perspective view thereof.
Figure 8C:
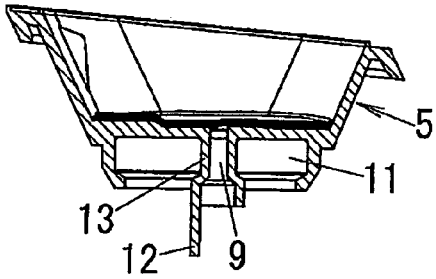
FIG. 8C is a section view taken along line C-C in FIG. 8A.
Figure 8D:
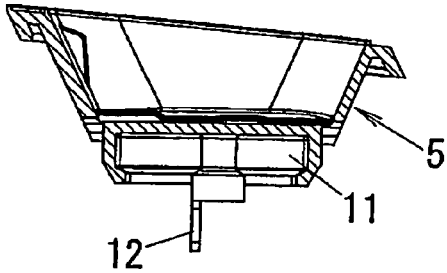
FIG. 8D is a section view taken along line D-D in FIG. 8B.

As can be seen in FIGS. 7A, 7B and 7E, a thin elongated air passage hole 9 extending along a longitudinal direction of the blade portion 32 is bored in the central portion of the blade rest tray 5. The drying space 4 and the air guide passageway 8 communicate with each other through the air passage hole 9.

Ribs 22 having a convex shape and extending perpendicularly to the air passage hole 9 are formed on the front surface of the blade rest tray 5. The ribs 22 are provided in plural numbers and equi-spaced apart along the longitudinal direction of the blade portion 32. As illustrated in FIG. 7B, each of the ribs 22 has an upper surface that serves as a surface for supporting the blade surface 33 of the blade portion 32. Therefore, the air passage hole 9 is arranged to face the blade surface 33 of the blade portion 32 when the blade portion 32 is supported on the upper surfaces of the respective ribs 22. At this time, the air passage hole 9 is faced with a plurality of blade holes formed in the blade surface 33 so that the air flowing out of the air passage hole 9 can be fed to a hair piece chamber within a hair shaving head 34 through the plurality of blade holes.

Figure 9:
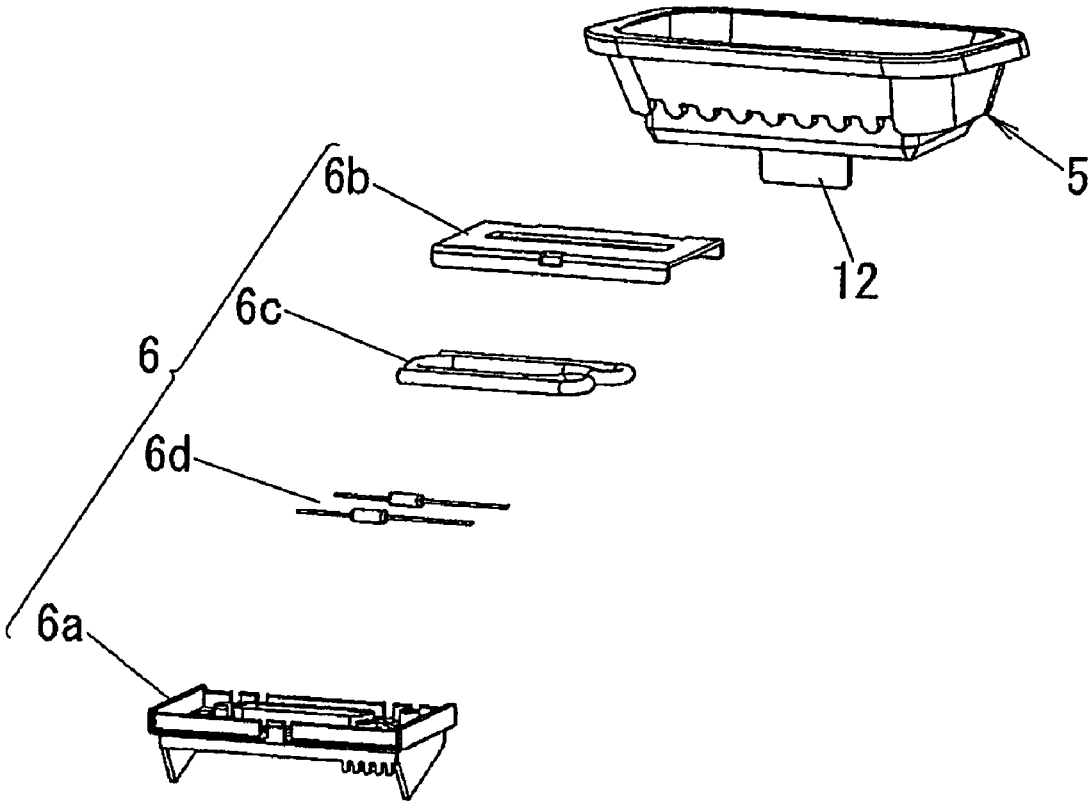
FIG. 9 is an exploded perspective view showing a heater attached to a bottom surface of the blade rest tray.

As can be seen in FIGS. 7A to 8D, a heater attachment recess 11 to which the heater 6 is attached is formed on the bottom surface of the blade rest tray 5. Referring to FIG. 9, the heater 6 includes a cartridge-like heater base 6*a*, a frame-like heater plate 6*b*, a ring-shaped heater wire 6*c* and a temperature fuse 6*d*. The heater 6 further includes a heater temperature detecting part 35 (shown in FIG. 11) which is formed of a thermistor, and a heater circuit board (not shown).

On the bottom surface of the blade rest tray 5, there is also formed an air passage tube 13 in such a way as to extend the inside of the heater 6. The air passage tube 13 communicates at one end with one end portion of the air passage hole 9 and at the other end with the air guide passageway 8. Reference numeral "12" in FIGS. 7A to 9 designates a grip piece projecting from the air passage tube 13. The task of attaching the heater 6 into the heater attachment recess 11 formed on the bottom surface of the blade rest tray 5 can be easily performed by gripping the grip piece 12 with the fingers.

As shown in FIGS. 7A and 7B, concave grooves 23 recessed from the upper surfaces of the ribs 22 are formed between the convex ribs 22 provided on the front surface of the blade rest tray 5. Water drainage holes 10 are formed in one ends of the respective grooves 23 to ensure that the water droplets falling from the water-cleaned blade portion 32 is drained below the blade rest tray 5 therethrough.

Figure 1:
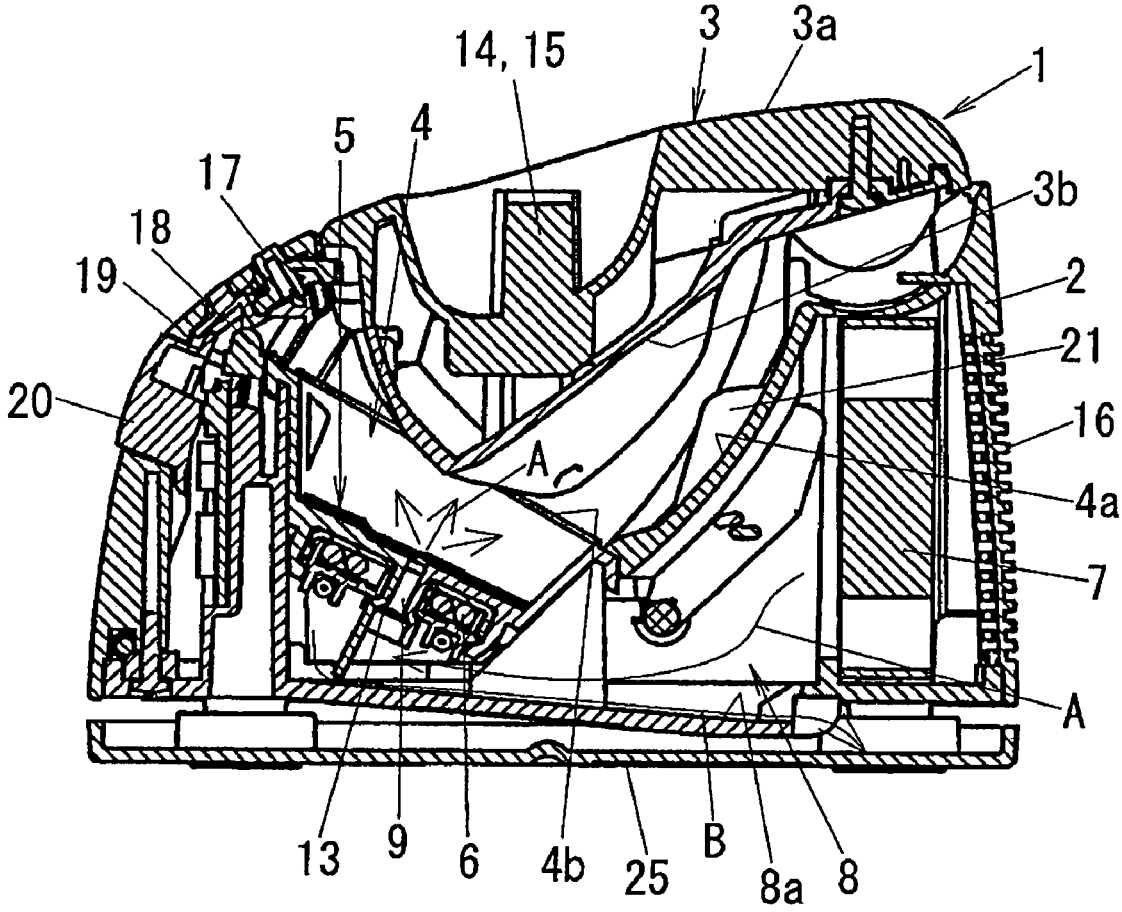
FIG. 1 is a side elevational section view showing a dryer for hair shaving devices in accordance with one embodiment of the present invention.

In the present embodiment, the water drainage holes 10 are arranged above a bottom surface portion 8*a* of the air guide passageway 8 that extends from the fan 7 to the air passage hole 9 as shown in FIG. 1. The bottom surface portion 8*a* is downwardly inclined with a gradient B in the opposite direction from an air blowing direction A so that the water flowing down through the water drainage holes 10 can be drained in the direction of the gradient B (in the opposite direction from the air blowing direction A). The bottom surface portion 8*a* is opened at its lower end toward a tray 25 arranged in the bottom portion of the casing 2, so that the drained water can be collected in the tray 25.

The tray 25 is separable from the bottom portion of the casing 2, and the water flowing out of the water drainage holes 10 is small in quantity and is easily evaporated when collected in the tray 25 so that the tray 25 can be cleaned with a reduced number of times.

On the upper surface of the casing 2 above the drying space 4, there is arranged a cover 3 for openably closing the blade portion insertion 4*b*. The cover 3 is hingedly connected at its rear end portion to the rear upper end of the casing 2 so that it can pivotally move upwardly or downwardly about a pivot shaft (not shown). The cover 3 is kept biased toward an opening direction by means of a torsion spring attached to the pivot shaft. A lock button 17 having a lock mechanism is provided to ensure that, once closed, the cover 3 is kept in a closed state by the lock mechanism of the lock button 17. If the lock button 17 is released, the lock mechanism comes out of engagement so that the cover 3 can be swung upwardly by means of the torsion spring and kept in an opened state.

The cover 3 of the present embodiment is opened upwardly during a drying operation of the dryer 1. When opened, the cover 3 functions as a support pillar capable of stably supporting a main body 31 of the hair shaving device that takes an upside-down posture with the blade portion 32 pointed downwards. In other words, as illustrated in FIGS. 2B and 4A to 4D, the cover 3 has a inner surface 3*b* concavely curved along the rear surface shape of the main body 31 of the hair shaving device assuming an upside-down posture. Therefore, the inner surface 3*b* of the cover 3 can be used as a backrest of the main body 31 of the hair shaving device.

FIGS. 4A to 5 illustrate a reciprocating electric razor as one example of the hair shaving device 30. The main body 31 of the hair shaving device 30 includes a secondary battery rechargeable with electric power supplied from a charging terminal 15 of the dryer 1, an electric motor and a switch. A hair shaving head 34 is mounted to the upper end of the main body 31 of the hair shaving device 30. The hair shaving head 34 is provided with the blade portion 32 that includes a net-like outer blade and a reciprocatingly driven inner blade kept in sliding contact with the outer blade.

Figure 6:
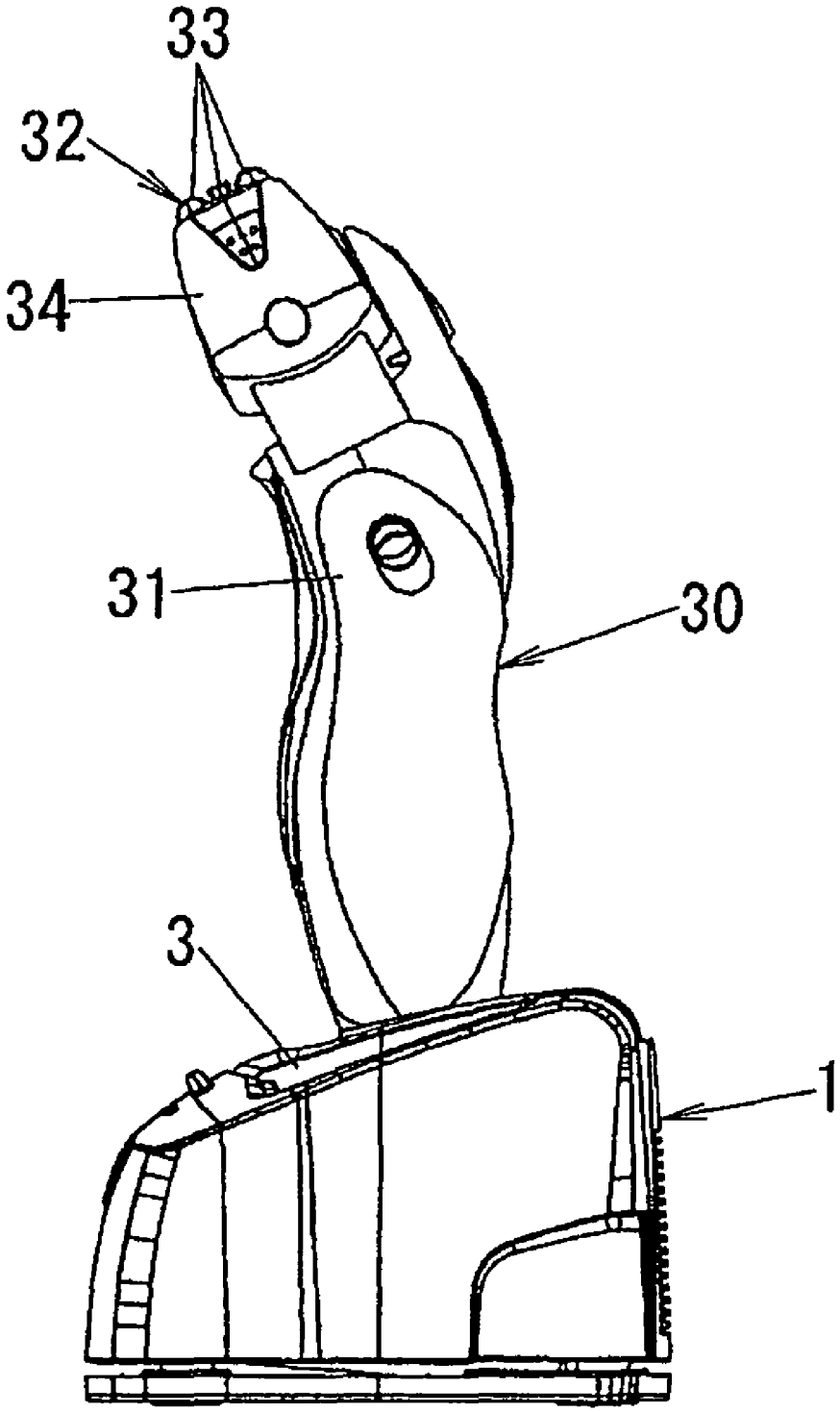
FIG. 6 is a view for explaining the recharging operation of the dryer for hair shaving devices.

The cover 3 is closed when the dryer 1 is not in use. As shown in FIGS. 1, 2A and 3A to 3E, the cover 3 is provided with a protruding portion 14 capable of holding the main body 31 of the hair shaving device 30 in a standing posture when the cover 3 is closed. The protruding portion 14 is formed at the center of an external surface 3*a* of the cover 3 and is exposed to the outside when the cover 3 is in a closed state. The main body 31 of the hair shaving device 30 can be kept in a standing posture as illustrated in FIG. 6 by coupling a connection terminal formed on the lower surface of the main body 31 of the hair shaving device 30 to the protruding portion 14.

In the present embodiment, the charging terminal 15 for recharging the main body 31 of the hair shaving device 30 is integrally formed with the protruding portion 14. Upon coupling the connection terminal of the main body 31 of the hair shaving device 30 to the protruding portion 14, the charging terminal 15 is brought into electrical contact with the main body 31 of the hair shaving device 30 so that the secondary battery can be recharged.

Figure 2A:
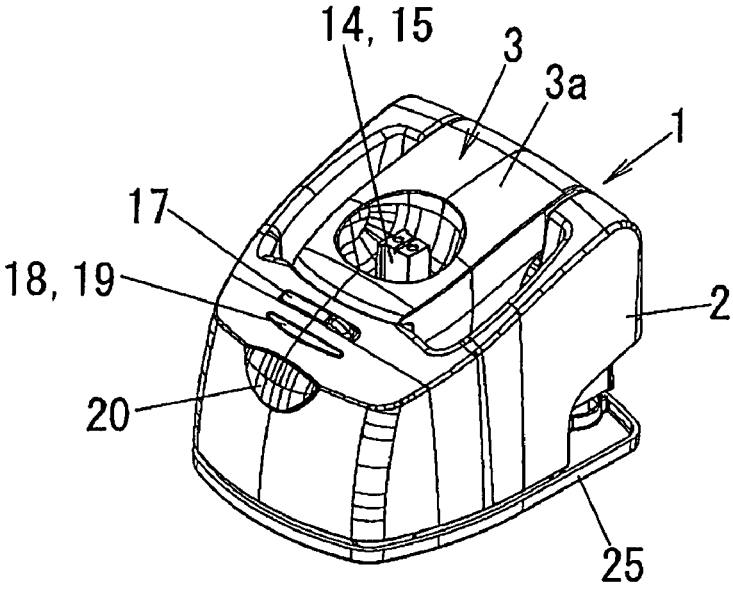
FIG. 2A is a perspective view of the dryer for hair shaving devices with a cover kept in an open state.
Figure 2B:
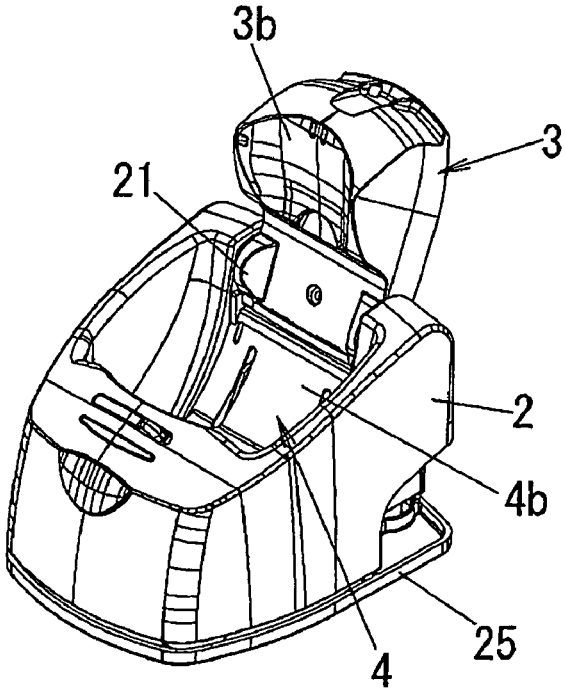
FIG. 2B is a perspective view of the dryer for hair shaving devices with the cover kept in a closed state.
Figure 3A:
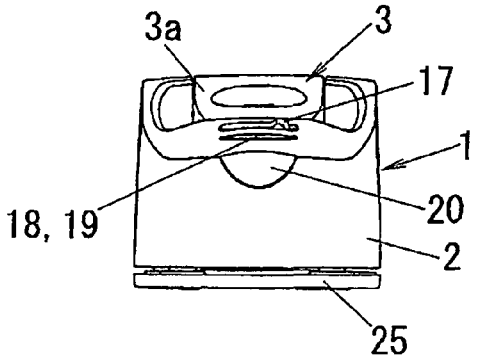
FIGS. 3A to 3E are respectively front, top, bottom, side and rear views of the dryer for hair shaving devices.
Figure 3B:
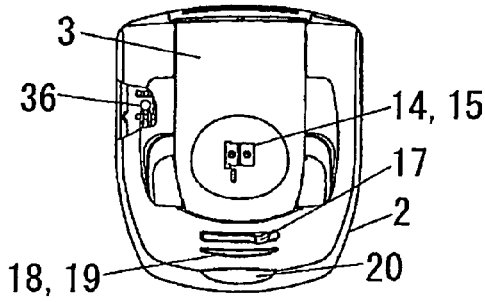
Figure 3C:
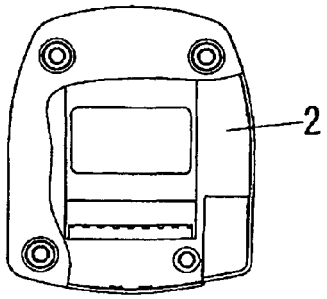
Figure 3D:
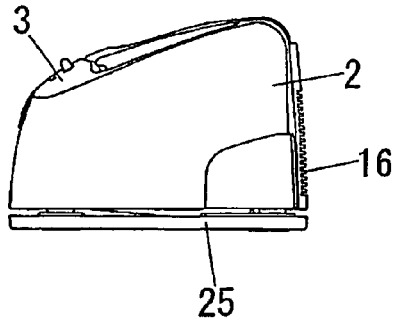
Figure 3E:
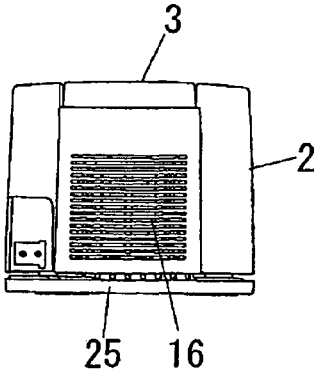

Referring to FIGS. 2A and 2B, the lock button 17 for locking the cover 3, a light-emitting diode 18 (hereinafter referred to as "LED 18") for emitting light during the operation of the dryer 1 and a main switch 20 for commanding the operation of the dryer 1 are arranged on the front surface of the casing 2. The LED 18 is of, e.g., a blue LED, and has a function of emitting light to display the operation of the dryer 1. Another function of the LED 18 is to irradiate ultraviolet rays on the blade portion 32 to sterilize the same. The surface of the LED 18 is shielded by a LED cover 19 to ensure that the ultraviolet rays are not directly irradiated on the eyes of a user. This helps keep the user safe.

A safety switch 21 is arranged on the rear surface 4*a* of the drying space 4 of the casing 2. The safety switch 21 is biased inwardly from the rear surface 4*a* of the drying space 4 by means of a spring 24 (shown in FIG. 5) and is kept in an off-state (the state shown in FIG. 1). In this state, the safety switch 21 prevents the dryer 1 from being operated even when the main switch 20 is turned on.

Figure 10:
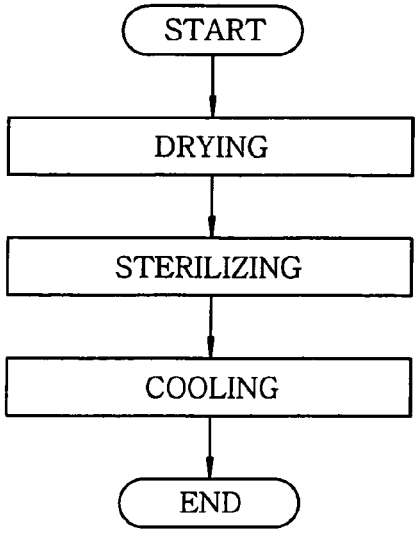
FIG. 10 is a view for explaining the operation modes performed from startup to stoppage of the dryer for hair shaving devices.
Figure 11:
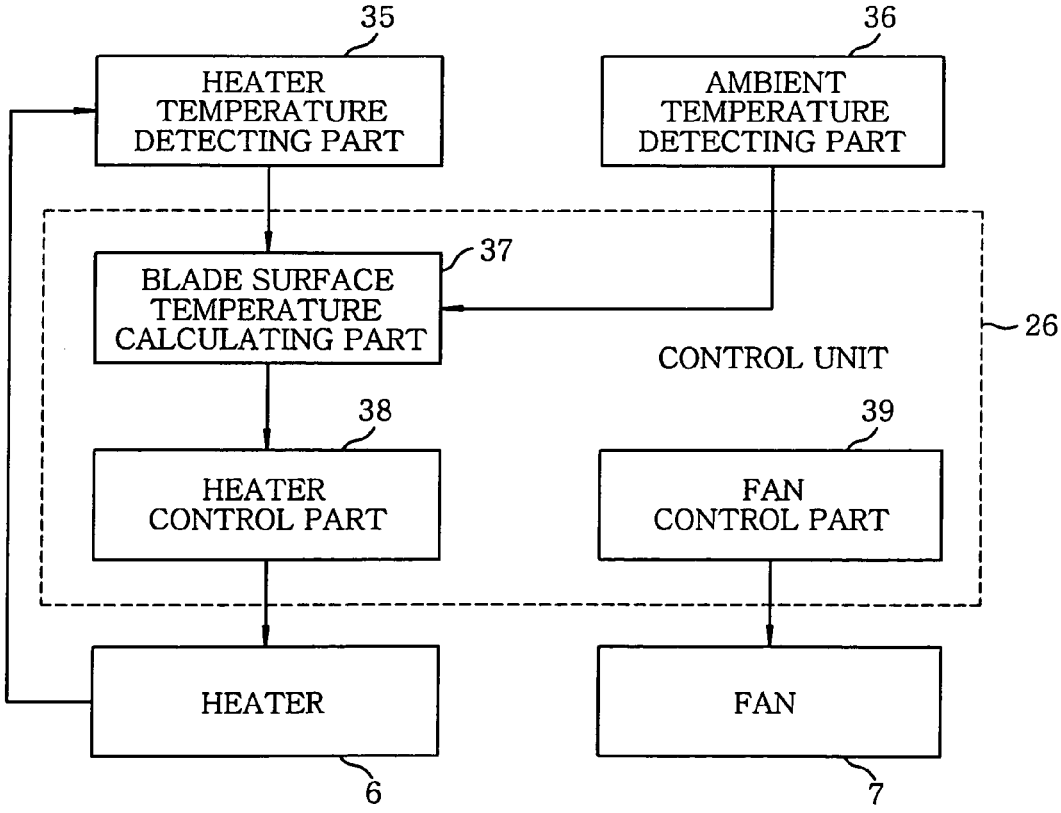
FIG. 11 is a block diagram showing a control unit and related parts of the dryer for hair shaving devices.

The dryer 1 of the present embodiment includes a control unit 26 formed of a microcomputer for controlling the output power of the heater 6 and the fan 7. FIG. 10 illustrates the operation modes performed from startup to stoppage of the dryer 1. The heater 6 and the fan 7 are simultaneously driven in a drying operation. The fan 7 is stopped and the heater 6 alone is driven in a sterilizing operation. The heater 6 is stopped and the fan 7 alone is driven in a cooling operation. FIG. 11 is a block diagram showing the control unit 26 and related parts.

The control unit 26 includes a blade surface temperature calculating part 37, a heater control part 38 and a fan control part 39. Although not shown in the drawings, the control unit 26 further includes a detection circuit for detecting the switching states of the main switch 20 and the safety switch 21 and a timer circuit for counting the execution time of the respective operation modes.

Figure 12:
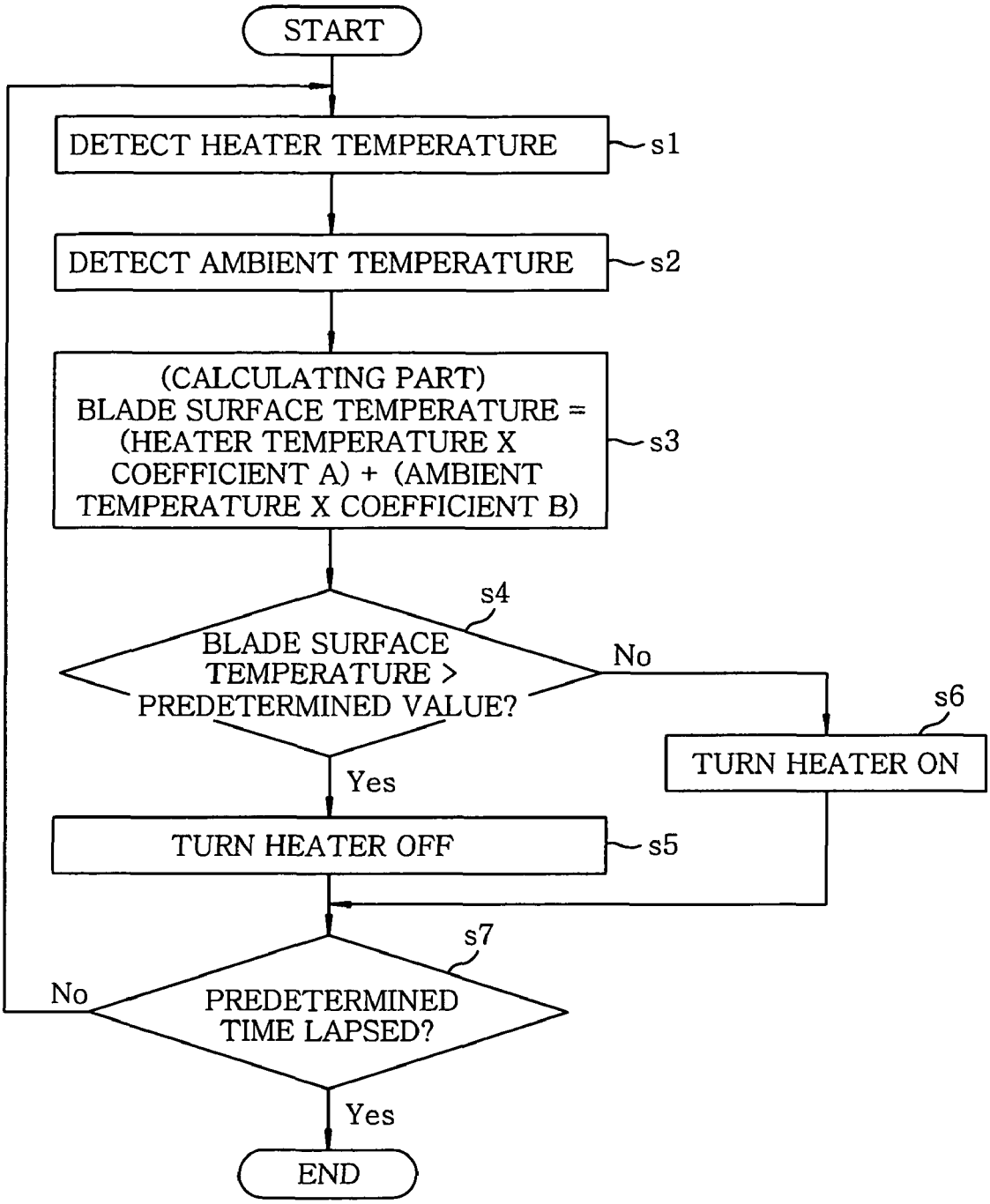
FIG. 12 is a flowchart illustrating the control flow of a heater of the dryer for hair shaving devices.

FIG. 12 is a flowchart illustrating one example of the control flow of the heater 6. In the drying operation and the sterilizing operation, the heater 6 is on-off controlled according to the detection results of a heater temperature detecting part 35 and an ambient temperature detecting part 36. In steps s1 and s2, the heater temperature is detected by the heater temperature detecting part 35 having a thermistor and the room temperature is detected by the ambient temperature detecting part 36 having a room temperature sensor. In step s3, the detection results are sent to the blade surface temperature calculating part 37 where the blade surface temperature is calculated. In steps s4 to s7, the heater 6 is on-off controlled in such a manner that the blade surface temperature becomes equal to a predetermined value. The on-off control is continuously performed until a predetermined time period lapses.

Next, when the dryer 1 is used, one example of the operation of the dryer 1 will be described.

Figure 4B:
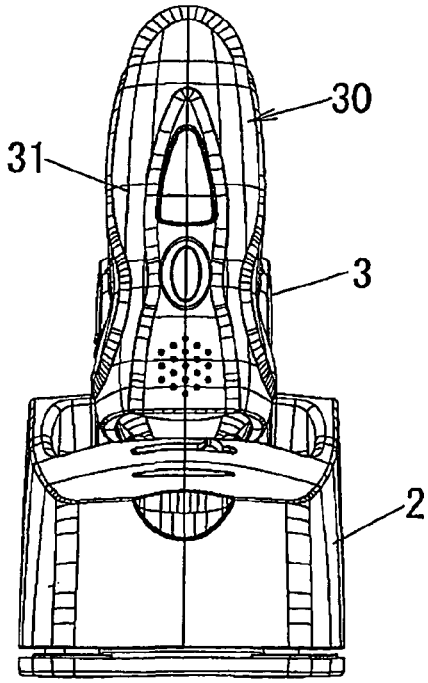
Figure 4C:
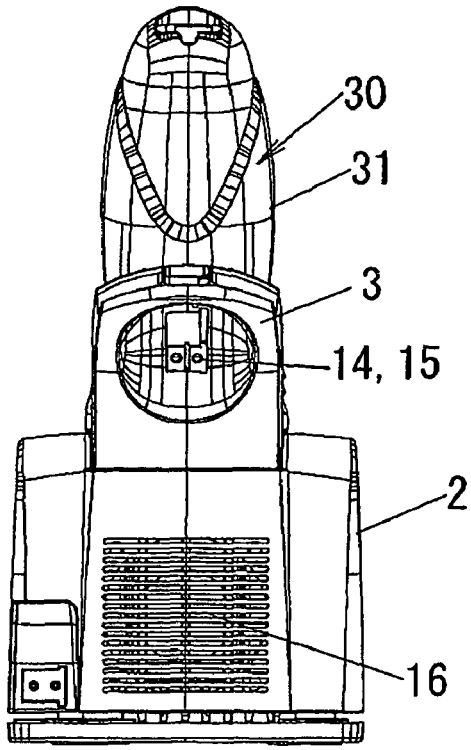
Figure 4D:
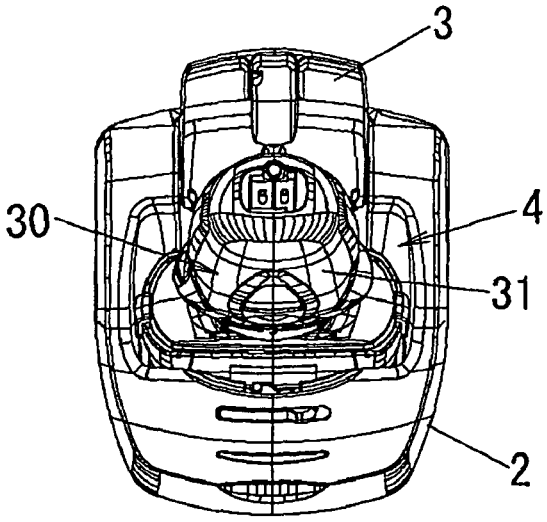

First, the cover 3 is opened as illustrated in FIG. 2B. The water-cleaned blade portion 32 of the hair shaving device 30 is turned downwardly and inserted into the drying space 4 through the blade portion insertion 4*b* of the casing 2 so that it can be placed on the blade rest tray 5 (as shown in FIGS. 4A to 4B and 5). At this time, the upside-down main body 31 of the hair shaving device 30 is stably supported on the inner surface 3*b* of the opened cover 3. Simultaneously, the rear surface portion of the main body 31 presses the safety switch 21 to bring the same into a turned-on state.

Then, the main switch 20 is pressed and turned on to start the operation of the dryer 1. Unless the safety switch 21 is turned on, the operation of the dryer 1 is not started even though the main switch 20 is operated into a turned-on state.

Once the main switch 20 is pressed, the control unit 26 initially performs a drying operation mode and brings both the heater 6 and the fan 7 into a turned-on state. Consequently, the air fed from the fan 7 is heated into a hot air by the heat generated from the heater 6. The hot air is allowed to flow along the air guide passageway 8 and injected toward the blade portion 32 through the air passage hole 9 provided at the blade rest tray 5 in the direction indicated by arrows A in FIG. 1, whereby the blade portion 32 is dried by the hot air. During this drying operation, the fan 7 is turned on at all times and the heater 6 is on-off controlled according to the detection results of the heater temperature detecting part 35 and the ambient temperature detecting part 36 as illustrated in FIG. 12.

Figure 13:
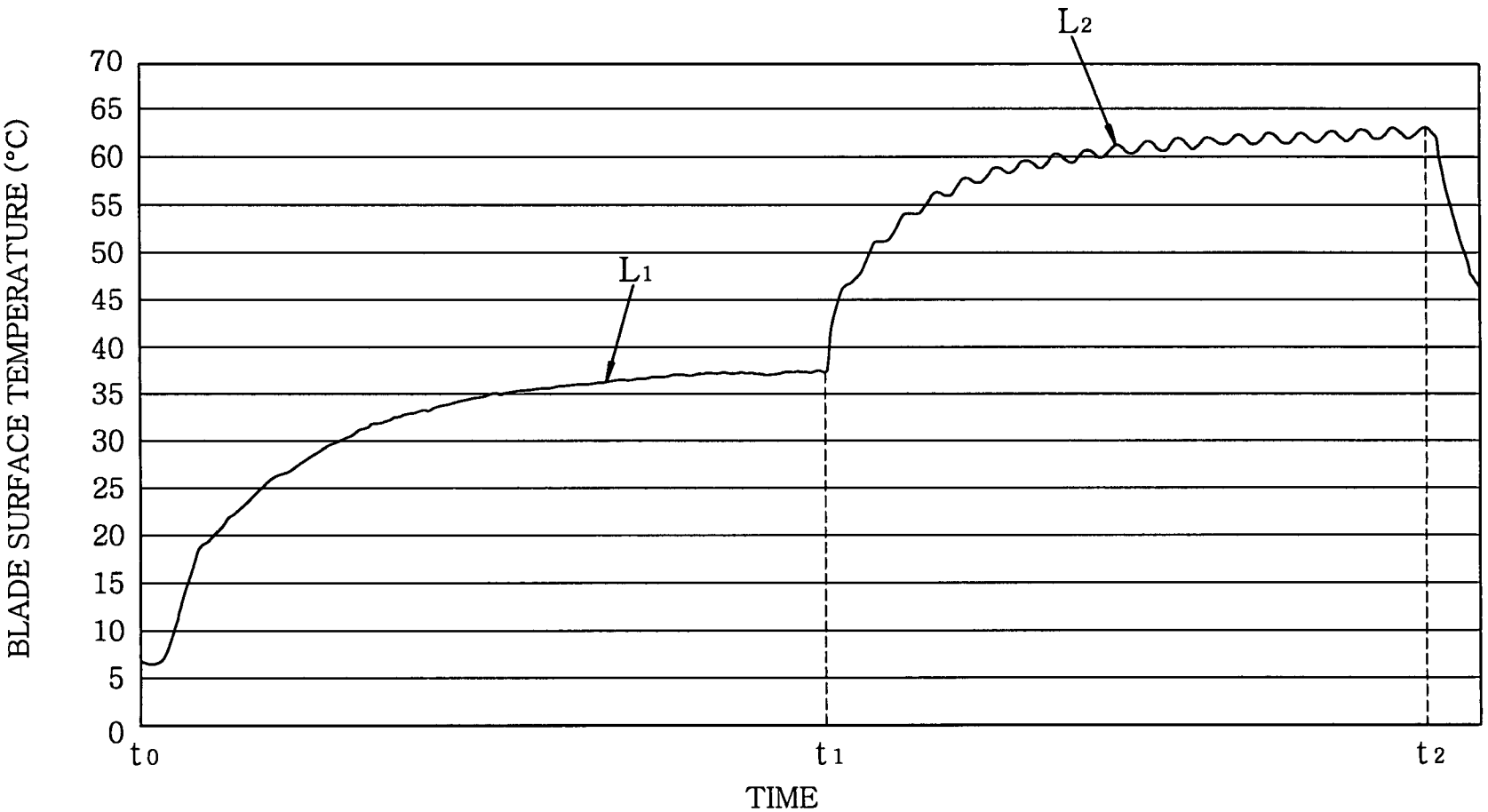
FIG. 13 is a graph plotting the blade surface temperature of the blade portion against the time during a drying operation and a sterilizing operation of the dryer for hair shaving devices.

At this time, the temperature of the heater 6 is controlled in such a manner that the blade surface temperature of the blade portion 32 is kept at a temperature level as indicated by a line L1 in FIG. 13. The drying operation time (from t0 to t1 in FIG. 13) is set equal to about two hours.

If about two hours lapse, the drying operation mode is converted to a sterilizing operation mode. During this sterilizing operation, the fan 7 is turned off at all times and the heater 6 is on-off controlled according to the detection results of the heater temperature detecting part 35 and the ambient temperature detecting part 36 as illustrated in FIG. 12. At this time, the heater temperature is set equal to or greater than 65° C. As a result, the heat generated from the heater 6 is efficiently transferred to the blade portion 32 through the blade rest tray 5 made of silicone rubber. The blade surface temperature of the blade portion 32 grows higher as indicated by a line L2 in FIG. 13, thereby performing a sterilizing task. The sterilizing operation time (from t1 to t2 in FIG. 13) is set equal to about twenty minutes.

If about twenty minutes lapse from then, the sterilizing operation mode is converted to a cooling operation mode. During the cooling operation, the heater 6 is turned off at all times and the fan 7 is turned on at all times, whereby the air introduced from the outside through the intake inlet 16 is guided along the air guide passageway 8 and injected through the air passage hole 9 of the blade rest tray 5 to thereby cool the blade portion 32. The cooling operation time is set equal to about ten minutes.

If about ten minutes lapse from then, the cooling operation mode comes to an end. The heater 6 and the fan 7 are all turned off, thereby terminating the operation of the dryer 1. Subsequently, upon separating the hair shaving device 30 from the dryer 1, the safety switch 21 is turned off. If the cover 3 is closed, the safety switch 21 prevents the dryer 1 from being operated even when the main switch 20 is pressed, eventually keeping the dryer 1 safe.

In this way, a series of operations (drying->sterilizing->cooling) are automatically performed by merely turning on the main switch 20 of the dryer 1. All that a user needs to do is to directly plug the blade portion 32 into the drying space 4 just after cleaning the blade portion 32 and to press the main switch 20. Therefore, there is no need for the user to make an effort in operating the dryer 1.

Use of the timer circuit makes it possible to automate the on-off operation of the heater 6 and the fan 7. This makes it possible to automatically control the drying time, the sterilizing time and the cooling time. Therefore, it becomes possible to efficiently perform the drying, sterilizing and cooling operations for the water-cleaned blade portion 32 within a shortened period of time, while avoiding unnecessary consumption of electric power. In other words, the drying, sterilizing and cooling operations can be sequentially performed by the simple control of turning on both the heater 6 and the fan 7, turning on only the heater 6 and then turning on only the fan 7.

During the drying operation, the hot air generated by the heater 6 and the fan 7 flows along the air guide passageway 8 and passes through the air passage hole 9 provided at the blade rest tray 5, thereby directly impinging on the blade surface 33 of the downwardly facing blade portion 32 from the lower side thereof. While the blade portion 32 is supported on the blade rest tray 5 at its lower end, it is possible to efficiently dry the blade portion 32 by allowing the hot air to directly impinge on the blade surface 33 of the downwardly facing blade portion 32 from the lower side thereof.

In the present embodiment, since the heater 6 is arranged on the bottom surface of the blade rest tray 5 and the air passage tube 13 is provided to extend through the inside of the heater 6, it is possible to secure an air passage extending from the bottom of the blade rest tray 5 to the air passage hole 9.

In addition, since the hot air supplied from the air passage hole 9 is sent to the inside of the hair shaving head 34 through the blade holes of the blade portion 32, it is possible for the hot air to be widely spread into the hair piece chamber of the hair shaving head 34. This makes it possible to sufficiently dry the inside of the hair shaving head 34 as well as the blade portion 32.

As a result, it becomes possible to greatly shorten the time required in drying the blade portion 32, as compared to the conventional drying method in which a blade portion is dried by exposing the flank surface of a hair shaving head 34 to air flow.

In the present embodiment, the heater 6 is attached to the bottom surface of the blade rest tray 5 made of silicone rubber. Therefore, if the heater temperature is set equal to or greater than 65° C., the heat generated from the heater 6 is easily transferred to the blade portion 32 through the blade rest tray 5 during the sterilizing operation. The effect of sterilizing various germs or bacteria adhering to the blade surface 33 or the blade holes is increased. In the present embodiment, the ultraviolet rays emitted from the LED 18 (such as a blue LED) for displaying the operation of the dryer 1 are irradiated on the blade portion 32. In combination with the heating made by the heater 6, this further enhances the sterilizing effect.

Since the blade portion 32 can be cooled down to a permissible temperature by the cooling operation immediately after the blade portion 32 is sterilized at an elevated temperature, it is possible for a user to safely use the sterilized blade portion 32.

Furthermore, in the present embodiment, when the dryer 1 is in use, the opened cover 3 serves as a support pillar for supporting the main body 31 of the hair shaving device 30. Therefore, the opened cover 3 plays a role of a backrest that stably supports the main body 31 of the hair shaving device 30, so that the blade portion 32 inserted into the drying space 4 is stably pressed against the blade rest tray 5.

When the dryer 1 is not in use, the cover 3 is closed so that it can cover the blade portion insertion 4*b* of the drying space 4. This helps prevent dust or wastes from entering the drying space 4 and also assists in eliminating the cause of propagation of germs or generation of a bad smell. Therefore, it becomes possible to keep the inside of the casing 2 hygienic at all times. Moreover, there is no fear that flammable dust or wastes is gathered within the casing 2 so that the heater temperature can be particularly increased during the sterilizing operation. Consequently, it is possible to enhance the sterilizing effect and also to shorten the time required in the sterilizing operation.

Furthermore, the protruding portion 14 formed on the external surface 3*a* of the cover 3 is capable of holding the main body 31 of the hair shaving device 30 with the blade portion 32 kept in an upwardly facing posture. Thus, the dryer 1 can be used as a stand for keeping the hair shaving device 30 while it is not used.

Moreover, the protruding portion 14 is provided with the charging terminal 15 in the present embodiment. Therefore, the main body 31 of the hair shaving device can be recharged by use of the charging terminal 15 formed in the protruding portion 14 in a state that the main body 31 is kept in a standing posture by the protruding portion 14. This makes it possible to use the dryer 1 as a stand for recharging the hair shaving device 30, which helps expand the functions of the dryer 1.

In the present embodiment, even when water droplets are formed on the water-cleaned blade portion 32, they are drained through the water drainage holes 10 formed in the grooves 23 of the blade rest tray 5. Therefore, there is no possibility that the water droplets are gathered on the blade rest tray 5, which would otherwise hinder the drying operation of the blade portion 32. The water droplets falling down through the water drainage holes 10 are drained into the tray 25 along the inclined bottom surface portion 8*a* of the air guide passageway 8. Therefore, the need to form a special drainage path within the casing 2 can be eliminated by merely forming the water drainage holes 10 in the blade rest tray 5.

This provides an advantage to simplify the structure of the dryer 1 while assuring increased drainage performance.

Although the intake inlet 16 of the dryer 1 is formed in the rear surface of the casing 2 in the foregoing embodiment, the intake inlet 16 may be formed in the lower surface of the casing 2. In this case, the air guide passageway 8 extends vertically, necessarily increasing the vertical dimension of the casing 2.

In order to reduce the vertical dimension of the casing 2 and stabilize the dryer 1, it is therefore desirable to employ the structure of the foregoing embodiment in which the air guide passageway 8 is bent into a "U"-like shape and is brought into communication with the intake inlet 16 formed in the rear surface of the casing 2.

Furthermore, although the charging terminal 15 is formed in the protruding portion 14 of the cover 3 for holding the main body 31 of the hair shaving device 30 in a standing posture according the foregoing embodiment, the charging terminal 15 may be formed in a portion other than the protruding portion 14.

For example, the charging terminal 15 may be formed on the inner surface 3*b* of the cover 3. In this case, when the main body 31 is supported on the inner surface 3*b* of the cover 3, the connection terminal arranged on the rear surface of the main body 31 of the hair shaving device 30 is connected to the charging terminal 15 formed on the inner surface 3*b* of the cover 3.

As another example, the charging terminal 15 may be formed on the rear surface 4*a* of the drying space 4 of the casing 2. In this case, when the blade portion 32 is inserted into the drying space 4, the connection terminal arranged on the rear surface of the main body 31 of the hair shaving device 30 is connected to the charging terminal 15. In both cases, it is possible to recharge the main body 31 of the hair shaving device 30 while drying and sterilizing the blade portion 32. This makes it convenient to use the dryer 1.

The dryer for hair shaving devices in accordance with the present invention is not limited to drying and sterilizing a blade portion of an electric razor but may be widely applied to drying and sterilizing a blade portion of other kinds of hair shaving devices for use in cutting or plucking body hairs.

While the invention has been shown and described with respect to the embodiments, it will be understood by those skilled in the art that various changes and modification may be made without departing from the scope of the invention as defined in the following claims.

What is claimed is:

1. A dryer for hair shaving devices, comprising:

a casing having a drying space for removably receiving a blade portion of a hair shaving device, a blade rest tray, arranged in a bottom portion of the drying space, for receiving the blade portion, an air passage hole provided in the blade rest tray, an air guide passageway communicating at one end thereof with an air intake inlet of the casing, and an air passage tube communicating at one end thereof with the air passage hole and at the other end thereof with the air guide passageway;

a heater and a fan for drying the blade portion received in the drying space; and a control unit for controlling output power of the heater and the fan to perform operation modes including a drying operation mode in which the heater and the fan are driven simultaneously and a sterilizing operation mode in which the heater alone is driven with the fan kept stopped, wherein the heater is arranged on a bottom surface of the blade rest tray, the air passage tube is formed to extend through an inside of the heater, and the fan is arranged on an upstream side of the air guide passageway, and wherein the drying space and the air guide passageway communicate with each other through the air passage hole.

2. The dryer for hair shaving devices of claim 1, wherein the control unit is designed to perform the drying operation mode for a predetermined time period and then perform the sterilizing operation mode for a specified time period, the heater and the fan being driven simultaneously in the drying operation mode to dry the blade portion with a hot air, the fan being stopped and the heater alone being driven in the sterilizing operation mode to heat the blade portion by thermal conduction.

3. The dryer for hair shaving devices of claim 2, wherein the control unit controls the heater in such a condition as to heat the blade portion for ten minutes or more at a temperature of 65° C. or more during the sterilizing operation mode.

4. The dryer for hair shaving devices of claim 1, wherein the control unit controls the heater in such a condition as to heat the blade portion for ten minutes or more at a temperature of 65° C. or more during the sterilizing operation mode.

* * * * *